US010414633B1

(12) United States Patent
Westendorf et al.

(10) Patent No.: US 10,414,633 B1
(45) Date of Patent: Sep. 17, 2019

(54) GRAPPLING ASSEMBLY FOR USE WITH UTILITY EQUIPMENT

(71) Applicant: Westendorf Manufacturing Co., Inc., Onawa, IA (US)

(72) Inventors: Matthew N. Westendorf, Onawa, IA (US); Neal W. Westendorf, Onawa, IA (US)

(73) Assignee: Westendorf Manufacturing Co., Inc., Onawa, IA (US)

( * ) Notice: Subject to any disclaimer, the term of this patent is extended or adjusted under 35 U.S.C. 154(b) by 0 days.

(21) Appl. No.: 16/133,900

(22) Filed: Sep. 18, 2018

Related U.S. Application Data

(60) Provisional application No. 62/659,727, filed on Apr. 19, 2018.

(51) Int. Cl.
*E02F 3/413* (2006.01)
*B66C 1/44* (2006.01)

(52) U.S. Cl.
CPC ..... *B66C 1/445* (2013.01); *E02F 3/4135* (2013.01)

(58) Field of Classification Search
CPC ..... A01G 23/003; B66C 1/427; B66C 1/585; B66C 3/04; B66C 3/16; B66C 3/18; B66C 1/445; B66F 9/18; E02F 3/3609; E02F 3/3618; E02F 3/3622; E02F 3/3627; E02F 3/3631; E02F 3/3636; E02F 3/3663; E02F 3/3668; E02F 3/3672; E02F 3/404; E02F 3/413; E02F 3/4133; E02F 3/4135; E02F 3/962
USPC ..... 37/302, 406, 468; 144/4.1, 34.1; 294/103.1, 104, 197, 198, 201, 203; 414/23, 686, 723, 724, 729, 732, 733, 414/735, 738, 739, 740, 741
See application file for complete search history.

(56) References Cited

U.S. PATENT DOCUMENTS 4,854,812 A * 8/1989 Smith ..... E02F 3/3622 414/723
2016/0281318 A1* 9/2016 Perry ..... E02F 3/3618
2016/0281322 A1* 9/2016 Burenga ..... E02F 3/404

* cited by examiner

*Primary Examiner* — Mark C Hageman
*Assistant Examiner* — Brendan P Tighe
(74) *Attorney, Agent, or Firm* — Joseph M. Butscher; The Small Patent Law Group, LLC

(57) ABSTRACT

A utility system may include at least one moveable arm, and at least one grappling assembly connected to the moveable arm. The grappling assembly includes an upper claw, a lower claw, and fasteners to pivotally secure the lower claw to the upper claw. The upper claw includes lower grasping surfaces and coupling openings. The lower claw includes upper grasping surfaces and mating openings. Each mating opening is axially aligned with one of the coupling openings. The upper and lower claws rotate about the fasteners at first pivot axes when the fasteners are retained within first coupling openings of the upper claw and within the mating openings of the lower claw. The upper and lower claw rotate about the fasteners at different, second pivot axes when the fasteners are retained within second coupling openings of the upper claw and within the mating openings of the lower claw.

20 Claims, 13 Drawing Sheets

GRAPPLING ASSEMBLY FOR USE WITH UTILITY EQUIPMENT

RELATED APPLICATIONS

This application relates to and claims priority benefits from U.S. Provisional Patent Application No. 62/659,727 entitled "Grappling Assembly For Use With Utility Equipment," filed Apr. 19, 2018, which is hereby incorporated by reference in its entirety.

FIELD OF THE DISCLOSURE

Embodiments of the present disclosure generally relate to a grappling assembly that may be attached to a utility component, such as a front loader, backhoe, crane, boom, or the like.

BACKGROUND OF THE DISCLOSURE

Work or utility vehicles, such as tractors, skid steers, four wheelers, bulldozers, and the like, are often adapted to be used with various types of attachments. For example, loaders may be attached to the front of such equipment with arms and hydraulic controls that allow the loader to be raised and lowered, and also rolled forward and backward. Many different implements may be attached to the front of the work vehicles, thereby allowing an operator to accomplish various tasks via a single work vehicle.

Conventional front-end loaders include a pair of lifting arms or boom assemblies that include towers or rearward ends that pivotally attach to a tractor and lifting arms or forward ends that pivotally attach to an implement. A coupler may be used to connect various implements to the lifting arms. As such, the owner of a work vehicle may change the implement attached to the work vehicle in order to address the needs of a particular job. Exemplary implements found on conventional front-end loaders include buckets, clam shells, plows, fork lifts, bale spears, and the like.

Generally, the arms of the loader and the attached implement may be controlled by a hydraulic system. Hydraulic cylinders may be configured to operate front-end loaders and their attached implements. Hydraulic lines may extend along an exterior (or routed along the interior) of the front-end loaders for powering the hydraulic cylinders.

Known attachments, such as grapplers, are typically connected to a boom assembly through a complicated linkage. Further, multiple actuating cylinders are typically connected to known grapplers in order to move grappling jaws with respect to one another. For example, a first hydraulic cylinder is operatively attached to an upper jaw, while a second hydraulic cylinder is operatively attached to a lower jaw. The use of multiple actuating cylinders may add time and cost to a manufacturing process.

Further, known upper and lower grappling jaws are pivotally secured to each other at a fixed pivot axis that limits how wide the grappling jaws may be spread apart when the grappling assembly is in a fully-opened position as well as limits the distance between the lower grappling jaw and a pivot point at the end of a loader arm. The fixed pivot axis also limits an amount of grasping force that can be generated by the grappling jaws. As such, the grappling assembly is limited to handling structures that fit between the grappling jaws and structures that need less than a certain amount of grasping force to handle. However, the operator may need to handle, grab, or move an element that has a size that is too large to fit between the grappling jaws or that may need an amount of grasping force greater than an amount of force that the grappling jaws can generate. The individual may view the purchase of different and distinct grappling assemblies that are sized to handle different structures having different sizes to be expensive and wasteful. Further, the time of completing a task is lengthened when the operator detaches the grappling jaws and attach a different grappler that is sized to handle the larger element.

SUMMARY OF THE DISCLOSURE

Certain embodiments of the present disclosure provide a grappling assembly that is configured to connect to a moveable arm of a utility component. The grappling assembly may include a first or upper claw and a second or lower claw. The upper claw includes first or lower grasping surfaces and coupling openings. The lower claw includes second or upper grasping surfaces and mating openings, wherein each mating opening is configured to be axially aligned with one of the coupling openings. Fasteners pivotally secure the lower claw to the upper claw. The fasteners are removably retained with the coupling openings of the upper claw and within the mating openings of the lower claw. The upper claw and the lower claw may rotate about the fasteners at first pivot axes when the fasteners are retained within first coupling openings of the upper claw and within the mating openings of the lower claw. The upper claw and the lower claw may rotate about the fasteners at different, second pivot axes when the fasteners are retained within second coupling openings of the upper claw and within the mating openings of the lower claw.

In at least one embodiment, the grappling assembly is connected to the moveable arm through a coupler.

In at least one embodiment, the second claw includes one or more stop bars that prevent rotation of the second claw in a direction towards the moveable arm.

The first claw may also include a main housing. The first grasping surfaces extend a distance away from the main housing.

Optionally, the first claw also includes lateral walls that extend a distance away from the main housing. The coupling openings of the first claw extend through at least one of the lateral walls.

Optionally, the first claw may also include a screen that extends at least partially along a surface of the main housing between the first grasping surfaces.

In at least one embodiment, the first claw includes grasping teeth and one or more connecting rods operably coupled with the grasping teeth.

In at least one embodiment, the second claw includes arcuate teeth and one or more connecting rods operably coupled with the arcuate teeth.

Optionally, at least one of the arcuate teeth includes a mounting end. The mating openings of the second claw extend through the mounting end of the at least one of the arcuate teeth.

In at least one embodiment, the grappling assembly is devoid of any additional linkages between the first claw and the second claw.

Each first grasping surfaces of the first claw may also include a grip. The grips maintain a position of a structure between the first grasping surfaces of the first claw and the second grasping surfaces of the second claw.

Certain embodiments of the present disclosure provide a grappling assembly configured to connect to a moveable arm of a utility component. The grappling assembly may include a first or upper claw, a second or lower claw, and fasteners configured to pivotally secure the lower claw to the upper claw. The upper claw includes one or more first or lower grasping surfaces and coupling openings. The lower claw includes one or more second or upper grasping surfaces and mating openings, wherein each mating opening is configured to be axially aligned with one of the coupling openings. The upper claw and the lower claw may rotate about the fasteners at first pivot axes when the fasteners are retained within first coupling openings of the upper claw and within the mating openings of the lower claw. The first pivot axes extend through the first coupling openings of the upper claw and the mating openings of the lower claw. The upper claw and the lower claw may rotate about the fasteners at different, second pivot axes when the fasteners are retained within second coupling openings of the upper claw and within the mating openings of the lower claw. The second pivot axes may extend through the second coupling openings of the upper claw and the mating openings of the lower claw. The second claw includes one or more stop bars that prevent rotation of the second claw in a direction towards the moveable arm.

The first claw may also include a main housing. The first grasping surfaces extend a distance away from the main housing.

Optionally, the first claw also includes lateral walls that extend a distance away from the main housing. The coupling openings of the first claw extend through at least one of the lateral walls.

Optionally, the first claw may also include a screen that extends at least partially along a surface of the main housing between the first grasping surfaces.

In at least one embodiment, the first claw includes grasping teeth and one or more connecting rods operably coupled with the grasping teeth.

In at least one embodiment, the second claw includes arcuate teeth and one or more connecting rods operably coupled with the arcuate teeth.

Optionally, at least one of the arcuate teeth includes a mounting end. The mating openings of the second claw extend through the mounting end of the at least one of the arcuate teeth.

Certain embodiments of the present disclosure provide a system that may include at least one moveable arm of a utility vehicle, and a grappling assembly removably secured to the at least one moveable arm. The grappling assembl(ies) may be similar to the embodiments described above.

Figure 1:
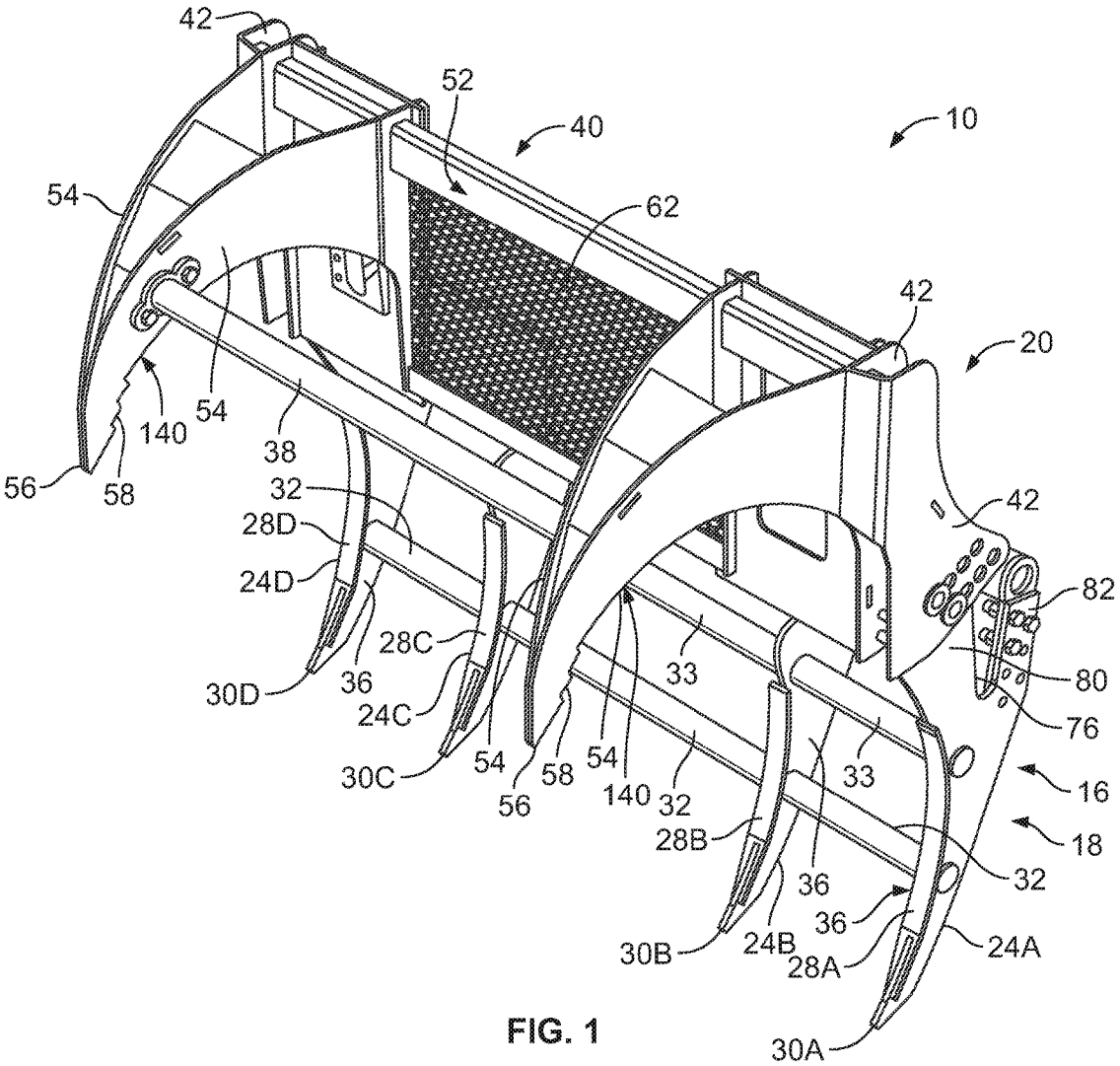
FIG. 1 illustrates a perspective view of a grappling assembly according to an embodiment of the present disclosure.

Before the embodiments are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Embodiments of the present disclosure may be used with various work or utility vehicles and/or equipment. For example, embodiments of the present disclosure may be used with respect to tractors, front loaders, backhoes, skid steers, and the like, such as described in U.S. Pat. No. 7,160,077, entitled "Grapple Assembly, A Front end Loader Having a Grapple Assembly, and Method for Operating a Grapple, Assembly," U.S. Pat. No. 7,431,554, entitled "Pinching Fingers Attachment for Utility Vehicles," U.S. Pat. No. 7,566,197, entitled "Independent Hydraulic Pinching Fingers Attachment for Utility Vehicles," and U.S. Pat. No. 8,221,049, entitled "Independent Hydraulic Pinching Fingers with Detachable Secondary Implement," all of which are hereby incorporated by reference in their entireties.

Figure 2:
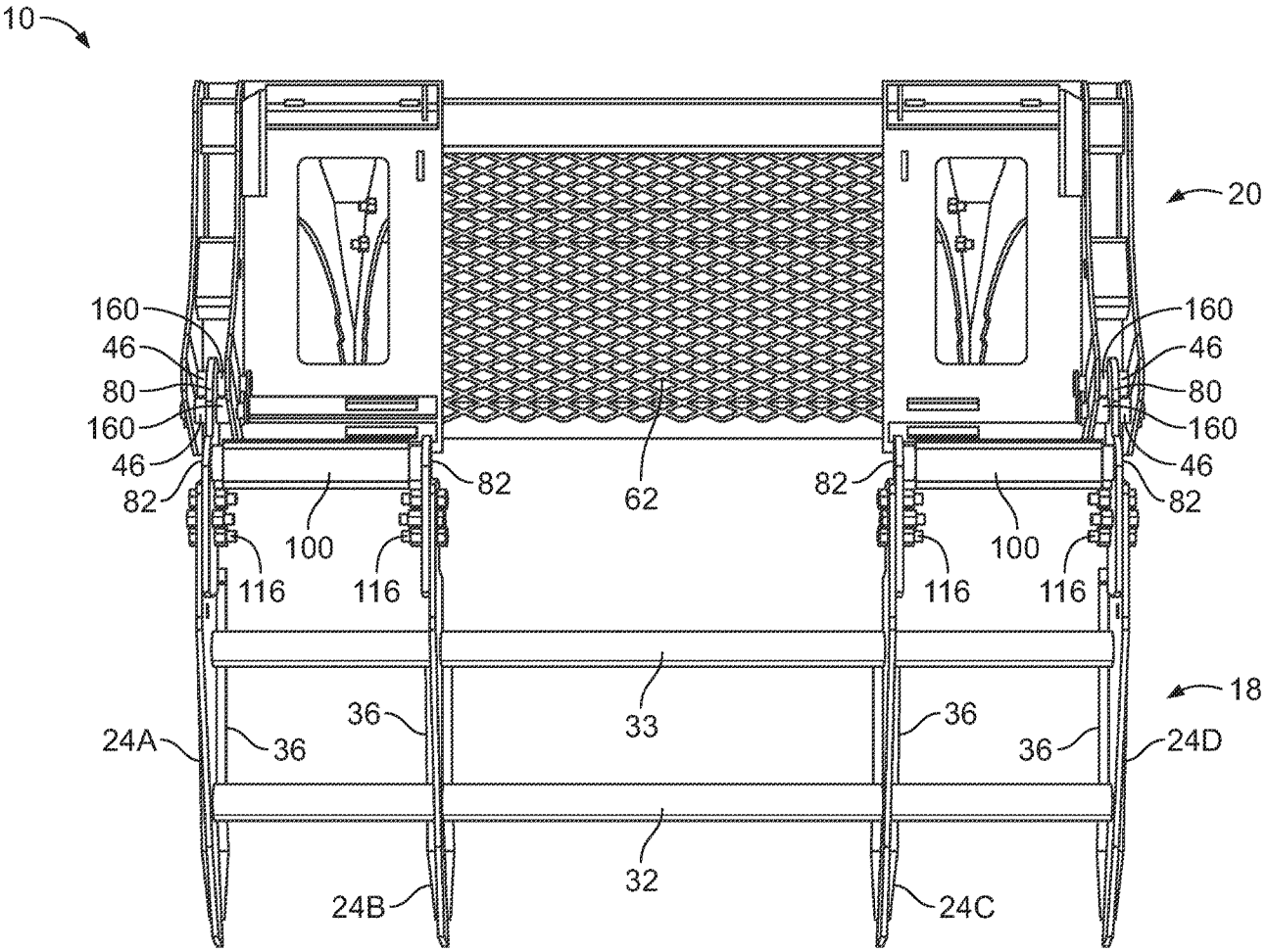
FIG. 2 illustrates a perspective back view of the grappling assembly of FIG. 1, according to an embodiment of the present disclosure.
Figure 3:
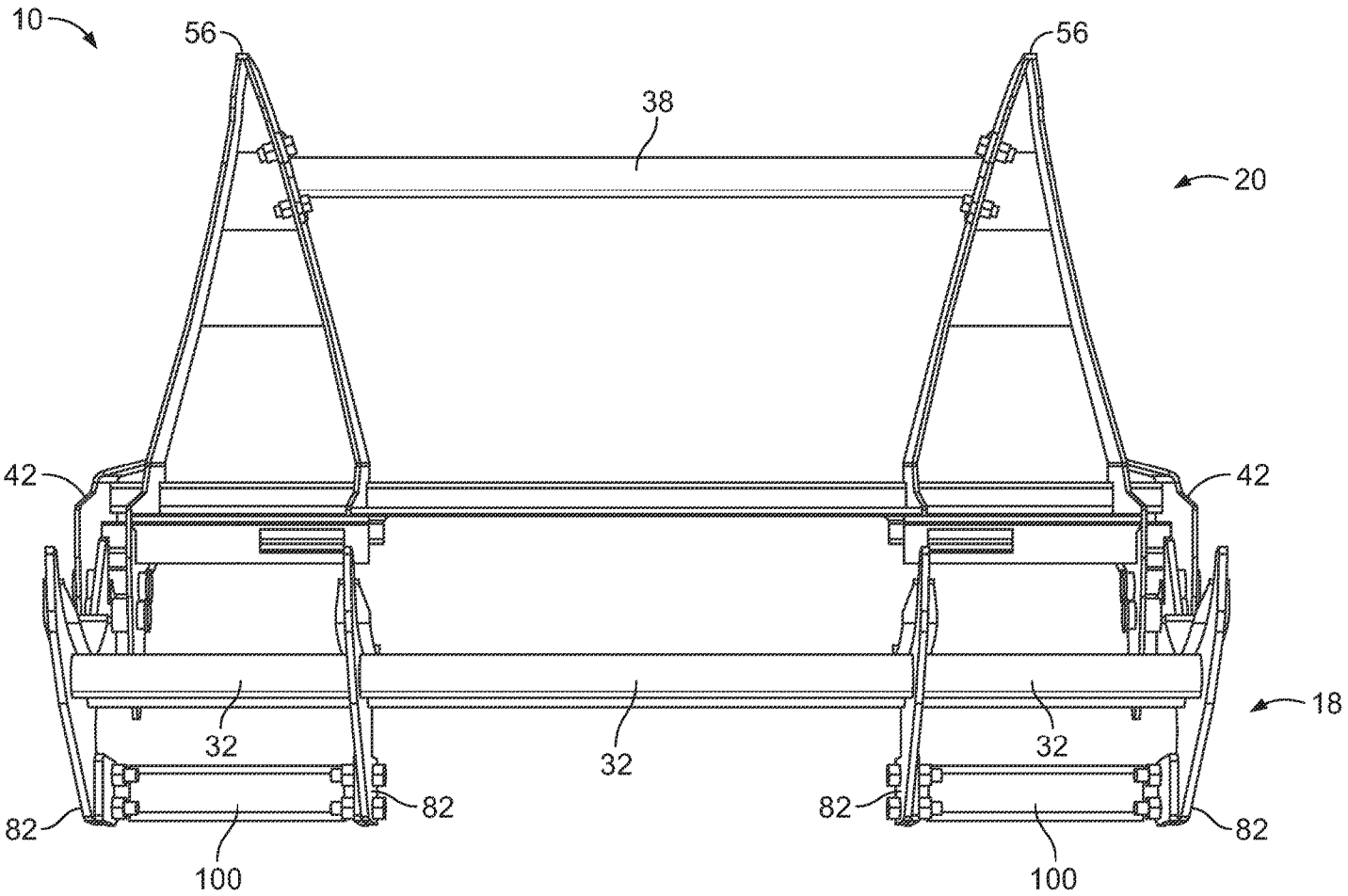
FIG. 3 illustrates a perspective bottom view of the grappling assembly of FIG. 1, according to an embodiment of the present disclosure.
Figure 4:
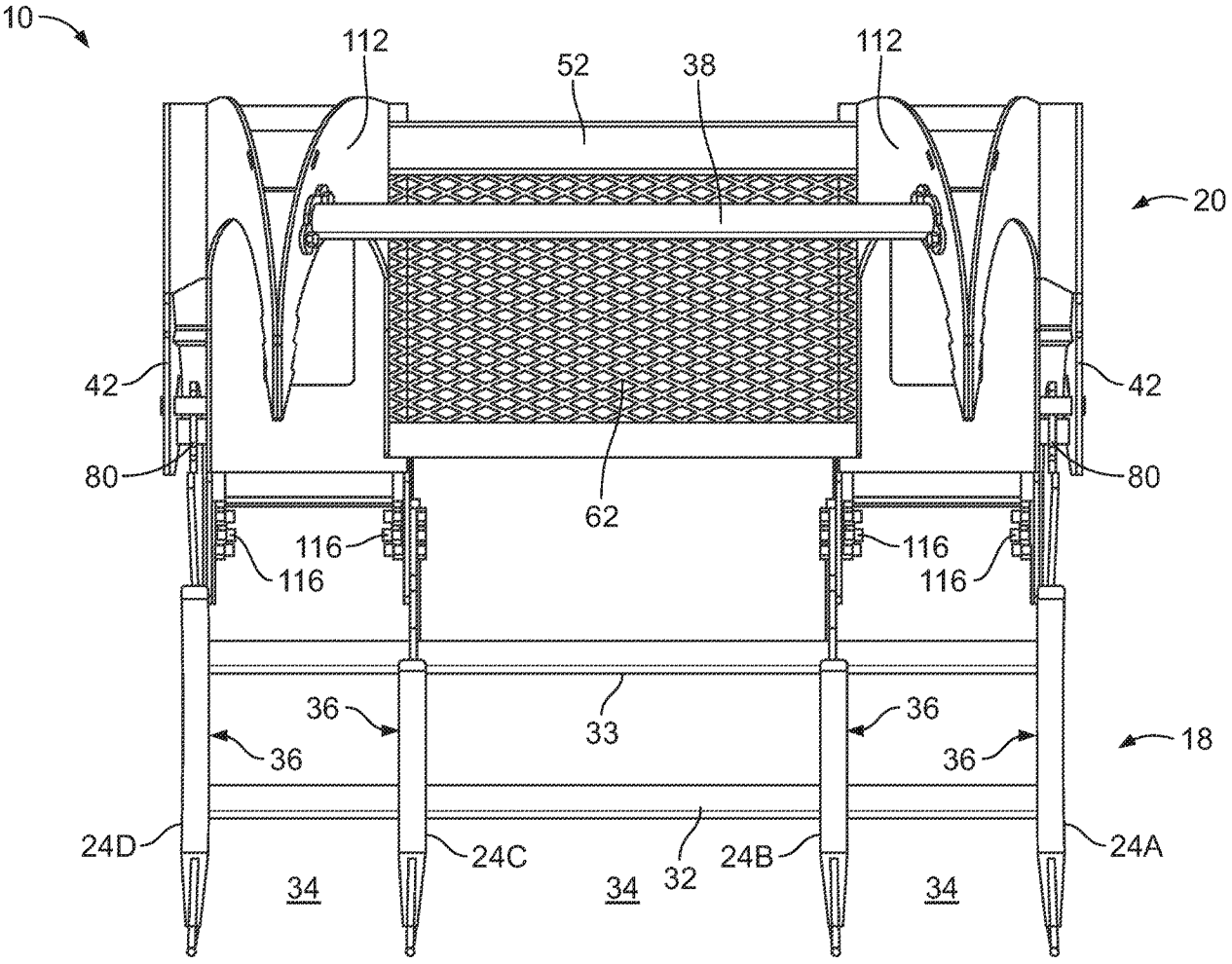
FIG. 4 illustrates a perspective front view of the grappling assembly of FIG. 1, according to an embodiment of the present disclosure.
Figure 5:
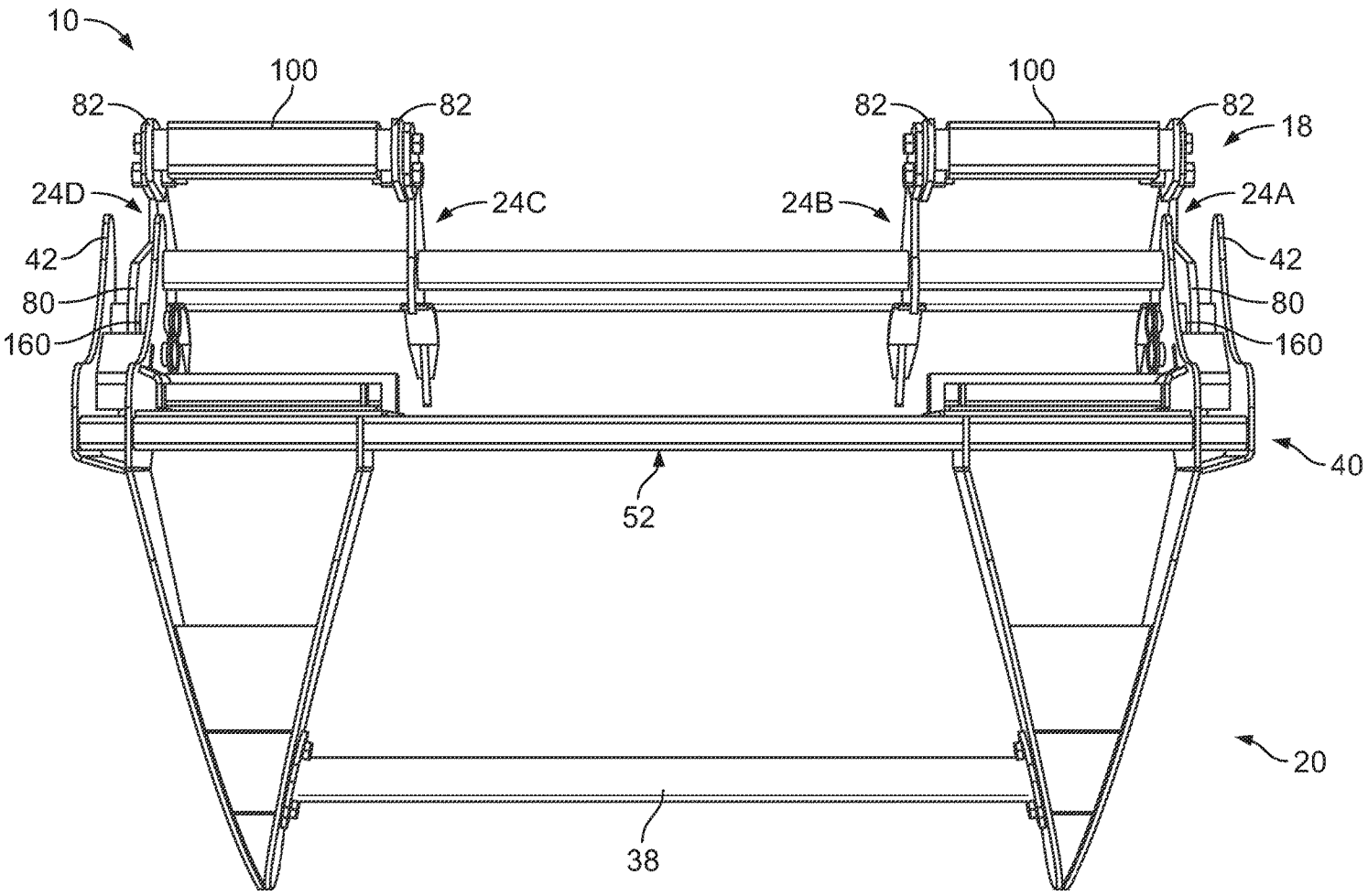
FIG. 5 illustrates a perspective top view of the grappling assembly of FIG. 1, according to an embodiment of the present disclosure.

FIG. 1 illustrates a perspective view of a grappling assembly 10 according to an embodiment of the present disclosure. FIG. 2 illustrates a perspective back view of the grappling assembly 10. FIG. 3 illustrates a perspective bottom view of the grappling assembly 10. FIG. 4 illustrates a perspective front view of the grappling assembly 10. FIG. 5 illustrates a perspective top view of the grappling assembly 10.

The grappling assembly 10 may be operably coupled with a utility component such as a front loader, skid steer, crane, boom, or the like, for example. In general, the utility component may typically be operatively connected to a bucket or shovel for digging, transporting, or the like. The bucket may be operatively connected to moveable arms. However, the bucket may be removed from the moveable arms, and couplers may be configured to securely connect to the grappling assembly 10. While a single grappling assembly is shown, it is to be understood that more grappling assemblies 10 may be used. For example, embodiments of the present disclosure may provide two grappling assemblies 10 such that each grappling assembly is separately coupled with two different moveable arms.

Referring to FIGS. 1-5, the grappling assembly 10 includes a lower claw 18 pivotally secured to an upper claw 20. The lower claw 18 includes plural arcuate teeth 24 that include a curved main body 16 having an upper grasping surface 28 and a distal tip 30, which may be pointed and configured to dig into structures, such as logs, brush, or the like. The upper grasping surfaces 28 may also be referred to herein as a second grasping surfaces. The four teeth 24 may be connected together through connecting rods 32, 33 that spans between each of the teeth 24. Each of the connecting rods 32, 33 may be single rods that extend between the four teeth 24, or the connecting rods 32, 33 may have multiple components or pieces that may extend between any of the teeth 24. Optionally, connecting rods 32, 33 may extend between a first tooth 24A and second tooth 24B, and different connecting rods may extend between a third tooth 24C and a fourth tooth 24D.

Gaps 34 span lengths between each of the arcuate teeth 24 along the length of the connecting rods 32, 33. In the illustrated embodiment, the gap 34 between the second tooth 24B and the third tooth 24C is greater than the gap 34 between the first tooth 24A and the second tooth 24B, and is greater than the gap 34 between the third tooth 24C and the fourth tooth 24D. While shown with four arcuate teeth 24, the lower claw 18 may include more or less than four teeth that may be connected together by more or less than two connecting rods 32, 33. For example, the lower claw 18 may alternatively include two opposing teeth 24 (e.g., the first tooth 24A and fourth tooth 24D). Additionally, the teeth 24 may be disposed at any uniform or unique distances apart from each other tooth along the length of the connecting rods 32, 33 such that the gaps 34 between teeth 24 may be substantially uniform or unique.

In one or more embodiments, one or both of the connecting rods 32, 33 may also be used to push a load in front of the teeth 24. For example, the connecting rods 32, 33 may act as a rake such that the rods 32, 33 may move a load in a forward direction when the grappling assembly 10 is open (e.g., the lower and upper claws 18, 20 are separated). Optionally, the grappling assembly 10 may include a screen (not shown) that may extend between any two or more of the teeth 24 along the connecting rods 32, 33 such that the screen may collect, block, push, or the like, a load in front of the teeth 24.

The main curved body of each of the arcuate teeth 24 of the lower claw 18 extends from a rear surface 76 of each tooth 24 to a free end 82. The free ends 82 extend away from the rear surfaces 76 in a direction away from the distal tip 30 of each arcuate tooth 24. As shown in FIGS. 2, 3 and 5, a stopping device, such as a stop bar 100, extends between the free end 82 of the first and second teeth 24A, 24B, and a stop bar 100 extends between the free end 82 of the third and fourth teeth 24C, 24D. Each stop bar 100 is operably coupled with the free ends 82 of the corresponding arcuate teeth 24 with plural fasteners 116. In the illustrated embodiment, the arcuate teeth 24 include plural openings that may receive the fasteners 116. For example, the position of each stop bar 100 relative to the position of the lower and upper claws 18, 20 may be changed or adjusted. Changing or adjusting the position of the stop bars 100 may allow the lower and upper claws 18, 20, and the corresponding teeth 24, 54 to open and/or close to a desired position. Optionally, the stop bars 100 may be coupled with the free ends 82 by welding, soldering, or any alternative method. The stop bars 100 are configured to abut into a lower or rear (depending on the orientation) surface of the moveable arm (shown in FIGS. 12-14) of the utility component and prevent further rotation of the lower claw 18 towards the moveable arm 14. Alternatively, the lower claw 18 may have less than two or more than two stop bars 100 or any alternative stopping devices that may be connectively coupled with or may be a unitary body with one or more of the arcuate teeth 24.

The upper claw 20 includes a main housing 40 having grasping teeth 54 that extend from a front surface 52 in a direction away from the main housing 40. The grasping teeth 54 are operably connected to each other by a connecting rod 38. The grasping teeth 54 converge at distal tips 56 that may be pivoted into the gaps 34 formed between the corresponding teeth 24 of the lower claw 18. In the illustrated embodiment, two grasping teeth 54 converge together to pivot into the gap 34 between the first and second teeth 24A, 24B, and two grasping teeth 54 converge together to pivot into the gap 34 between the third and fourth teeth 24C, 24D. Alternatively, single teeth 54 may extend from the main housing 40 of the upper claw 20 and may be configured to pivot into the gaps 34 between and/or outside of any of the teeth 24A-D of the lower claw 18. Further, the teeth configuration of the lower and upper claws 18, 20, respectively, may be switched or may have any alternative configuration and/or orientation.

Moreover, it is to be understood that the terms "upper" and "lower" are merely with respect to the orientations shown in the drawings. Embodiments of the present disclosure provide a grappling assembly that may include first claws 20 and second claws 18 that are configured to pivot relative to one another. Either of the first claw 20 and second claw 18 may be above or below the other. Indeed, the first and second claws 20, 18 may be oriented such that they open in non-vertical orientations, such that neither claw is above or below the other. Alternatively, the first and second claws 20, 18 may be oriented in a perpendicular direction. For example, the first and second claws may be horizontally-oriented such that the claws are configured to close about a vertical axis. In this embodiment, neither claws may be above or below the other, but, instead, positioned with respect to a horizontal plane.

The distal tip 56 of each tooth 54 includes a grip 58 that may grasp, dig into, and/or maintain a position of a structure that is positioned between the lower and upper claws 18, 20. For example, the grip 58 has a sawtooth shape to dig into and grasp the structure. Optionally, the grips 58 may have any alternative shape, roughed-surface, or the like. Additionally, each grasping tooth 54 of the upper claw 20 includes a lower grasping surface 140. The lower grasping surfaces 140 may also be referred to herein as first grasping surfaces. As such, the structure or the item positioned between the lower claw 18 and the upper claw 20 may be compressively grasped between the upper grasping surfaces 28 of the teeth 24 of the lower claw 18 and the lower grasping surfaces 140 of the grasping teeth 54 of the upper claw 20.

The upper claw 20 also includes a screen 62 that extends along the front surface 52 of the main housing 40 and spans a gap between the grasping teeth 54. For example, the screen 62 may contain or hold the structure (e.g., a log, brush, or the like) between the lower and upper claws 18, 20, such as when the structure is compressively grasped between the upper and lower grasping surfaces 28, 140. In the illustrated embodiment, the screen 62 extends substantially the entire gap between exterior surfaces 112 of the grasping teeth 54 along the front surface 52. Optionally, the upper claw may not include the screen, the screen may not span the entire gap between the grasping teeth, the upper claw may include two or more screens that span at least part of the gap, or any combination therein.

The upper claw 20 also includes plural lateral walls 42 that extend in a direction away from the main housing 40. In the illustrated embodiment, the lateral walls 42 extend in a direction substantially opposite the distal tips 56 of the grasping teeth 54. Optionally, the lateral walls 42 may extend in any alternative direction away from the main housing 40. The lateral walls 42 pivotally connect the upper claw 20 to the lower claw 18. The lateral walls 42 include plural coupling openings 60. Additionally, the curved main body 16 of the first and fourth teeth 24A, 24D have mounting ends 80 that include mating openings 160. The mounting ends 80 of the first and fourth teeth 24A, 24D are received between corresponding lateral walls 42 and are pivotally coupled to the corresponding lateral walls 42 of the upper claw 20. For example, each mating opening 160 of the lower claw 18 is aligned with one of the coupling openings 60 of the upper claw 20. Fasteners 46, such as bolts, are removably retained within the coupling openings 60 of the upper claw 20 and within the mating openings 160 of the lower claw 18 that are axially aligned with each of the coupling openings 60.

Figure 6:
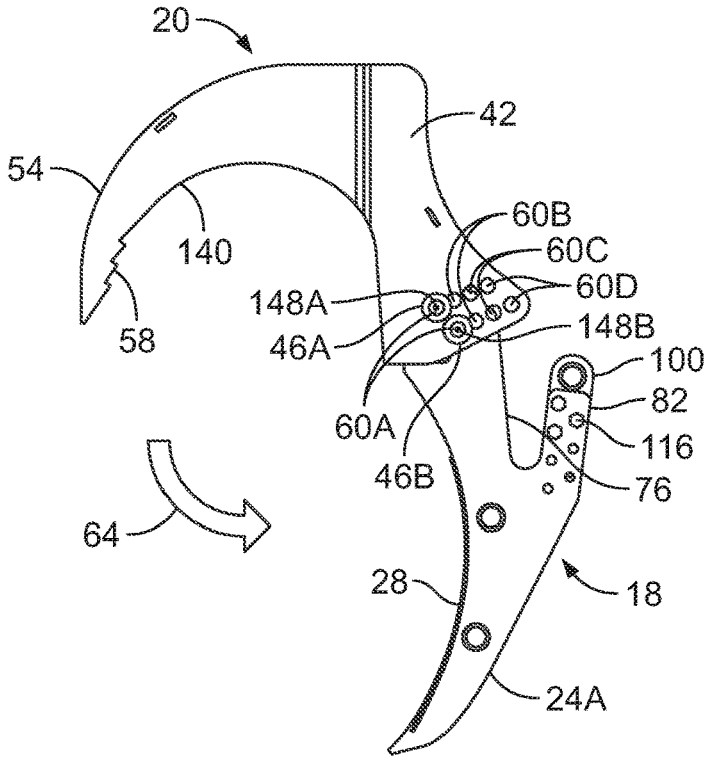
FIG. 6 illustrates a first side view of a lower claw pivotally secured to an upper claw with fasteners removably retained within first coupling openings, according to an embodiment of the present disclosure.
Figure 7:
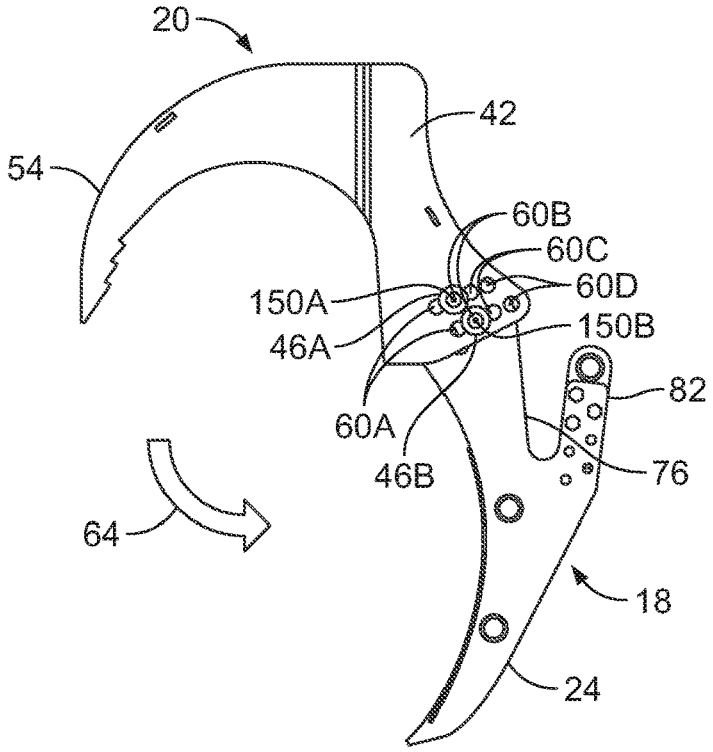
FIG. 7 illustrates a first side view of a lower claw pivotally secured to an upper claw with fasteners removably retained within second coupling openings, according to an embodiment of the present disclosure.
Figure 8:
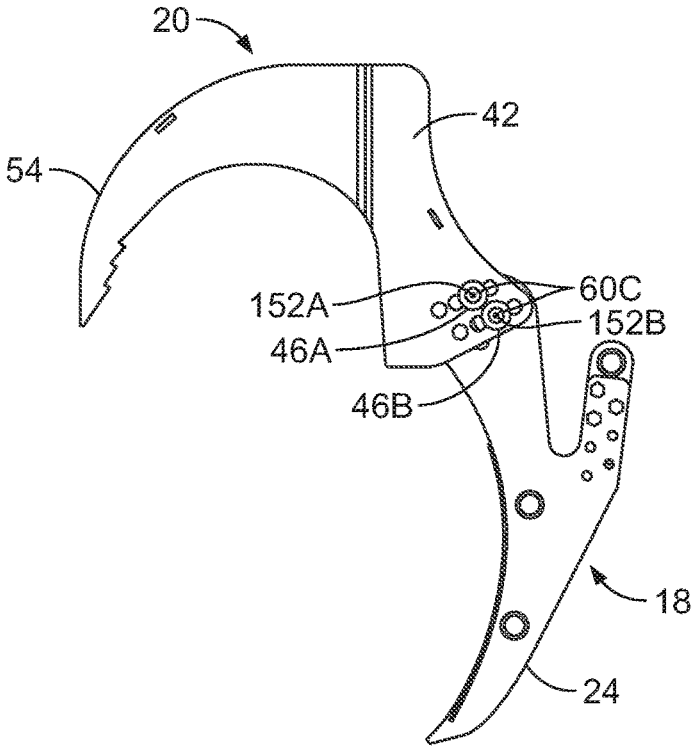
FIG. 8 illustrates a first side view of a lower claw pivotally secured to an upper claw with fasteners removably retained within third coupling openings, according to an embodiment of the present disclosure.
Figure 9:
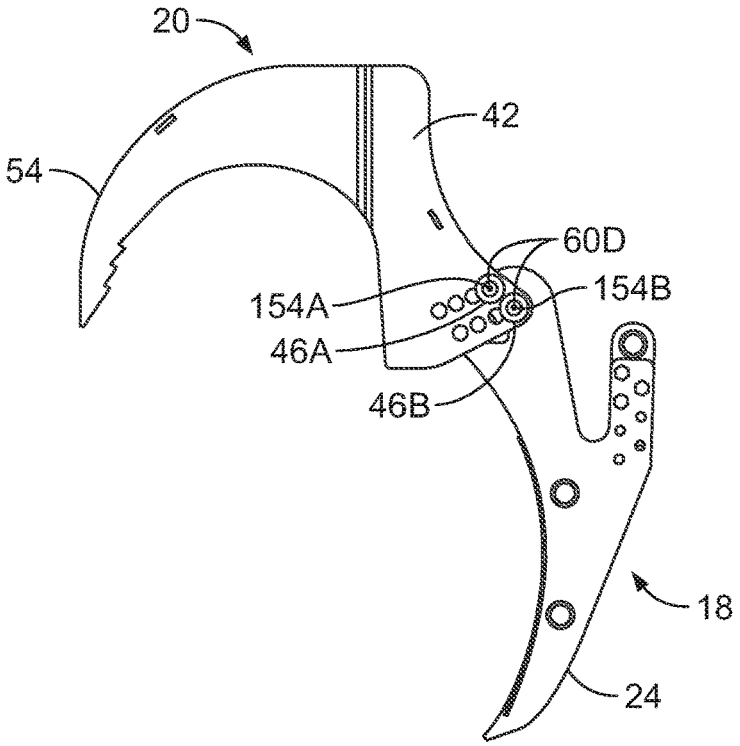
FIG. 9 illustrates a first side view of a lower claw pivotally secured to an upper claw with fasteners removably retained within fourth coupling openings, according to an embodiment of the present disclosure.

FIG. 6 illustrates a first side view of the lower claw 18 pivotally secured to the upper claw 20 with fasteners 46 removably retained within first coupling openings, according to an embodiment of the present disclosure. FIG. 7 illustrates the lower claw 18 pivotally secured to the upper claw 20 with fasteners 46 removably retained within second coupling openings. FIG. 8 illustrates the lower claw 18 pivotally secured to the upper claw 20 with fasteners 46 removably retained within third coupling openings. FIG. 9 illustrates the lower claw 18 pivotally secured to the upper claw 20 with fasteners 46 removably retained within fourth coupling openings.

Referring to FIGS. 6-9, the lower claw 18 may be pivotally secured to the upper claw 20 by removably retaining fasteners 46 within one or more coupling openings 60 of the upper claw 20 and within each corresponding mating opening 160 (shown in FIGS. 2 and 5) of the lower claw 18 that is axially aligned with the corresponding coupling openings 60. For example, the position of the lower claw 18 relative to the upper claw 20 may be adjusted or changed by removably retaining the fasteners 46 within different coupling openings 60 of the upper claw 20. Optionally, in one or more alternative embodiments, a fastener 46 may be removably retained within a single coupling opening and a single mating opening axially aligned with the single coupling opening.

As shown in FIG. 6, the lateral walls 42 of the upper claw 20 include four pairs of coupling openings 60A-D. The coupling openings 60 are arranged in two rows, and each row includes four openings. Each pair of coupling openings includes one opening from the top row and one opening from the bottom row. Alternatively, the upper claw 20 may have less than four or more than four pairs, each opening of each pair may be disposed at an alternative position relative to the other opening of each pair, the coupling openings may not be separated into pairs, or any combination therein.

The mating openings 160 of the lower claw 18 are axially aligned with the corresponding coupling openings of the upper claw 20 in order to removably retain the fasteners 46 and to pivotally secure the lower claw 18 to the upper claw 20. For example, as illustrated in FIG. 6, the fasteners 46 are retained within the mating openings (hidden from view in FIG. 6) of the lower claw 18 and within first coupling openings 60A, or a first pair of coupling openings. The fasteners 46 extending through the mating openings and the first coupling openings 60A define first pivot axes 148A, 148B about which the upper claw 20 pivots with respect to the lower claw 18 in a direction of arc 64. For example, a first fastener 46A defines first pivot axis 148A and a second fastener 46B defines first pivot axis 148B.

Alternatively, as illustrated in FIG. 7, the lower claw 18 may be pivotally secured to the upper claw 20 when the fasteners 46 are retained within different, second coupling openings 60B, or a second pair of coupling openings, and within the mating openings (hidden from view in FIG. 7) of the lower claw 18 axially aligned with the second coupling openings 60B. The fasteners 46 extending through the mating openings and the second coupling openings 60B define second pivot axes 150A, 150B about which the upper claw 20 pivots with respect to the lower claw 18 in the direction of arc 64. For example, the first fastener 46A defines the second pivot axis 150A and the second fastener 46B defines the second pivot axis 150B.

Alternatively, as illustrated in FIG. 8, the lower claw 18 may be pivotally secured to the upper claw 20 when the fasteners 46 are retained within different, third coupling openings 60C, or a third pair of coupling openings, and within the mating openings (hidden from view in FIG. 8) of the lower claw 18 axially aligned with the third coupling openings 60C. The fasteners 46 extending through the mating openings and the third coupling openings 60C define third pivot axes 152A, 152B about which the upper claw 20 pivots with respect to the lower claw 18 in the direction of arc 64. For example, the first fastener 46A defines the third pivot axis 152A and the second fastener 46B defines the third pivot axis 152B.

Alternatively, as illustrated in FIG. 9, the lower claw 18 may be pivotally secured to the upper claw 20 when the fasteners 46 are retained within different, fourth coupling openings 60D, or a fourth pair of coupling openings, and within the mating openings (hidden from view in FIG. 9) of the lower claw 18 axially aligned with the fourth coupling openings 60D. The fasteners 46 extending through the mating openings and the fourth coupling openings 60D define fourth pivot axes 154A, 154B about which the upper claw 20 pivots with respect to the lower claw 18 in the direction of arc 64. For example, the first fastener 46A defines the fourth pivot axis 154A and the second fastener 46B defines the fourth pivot axis 154B.

Figure 10:
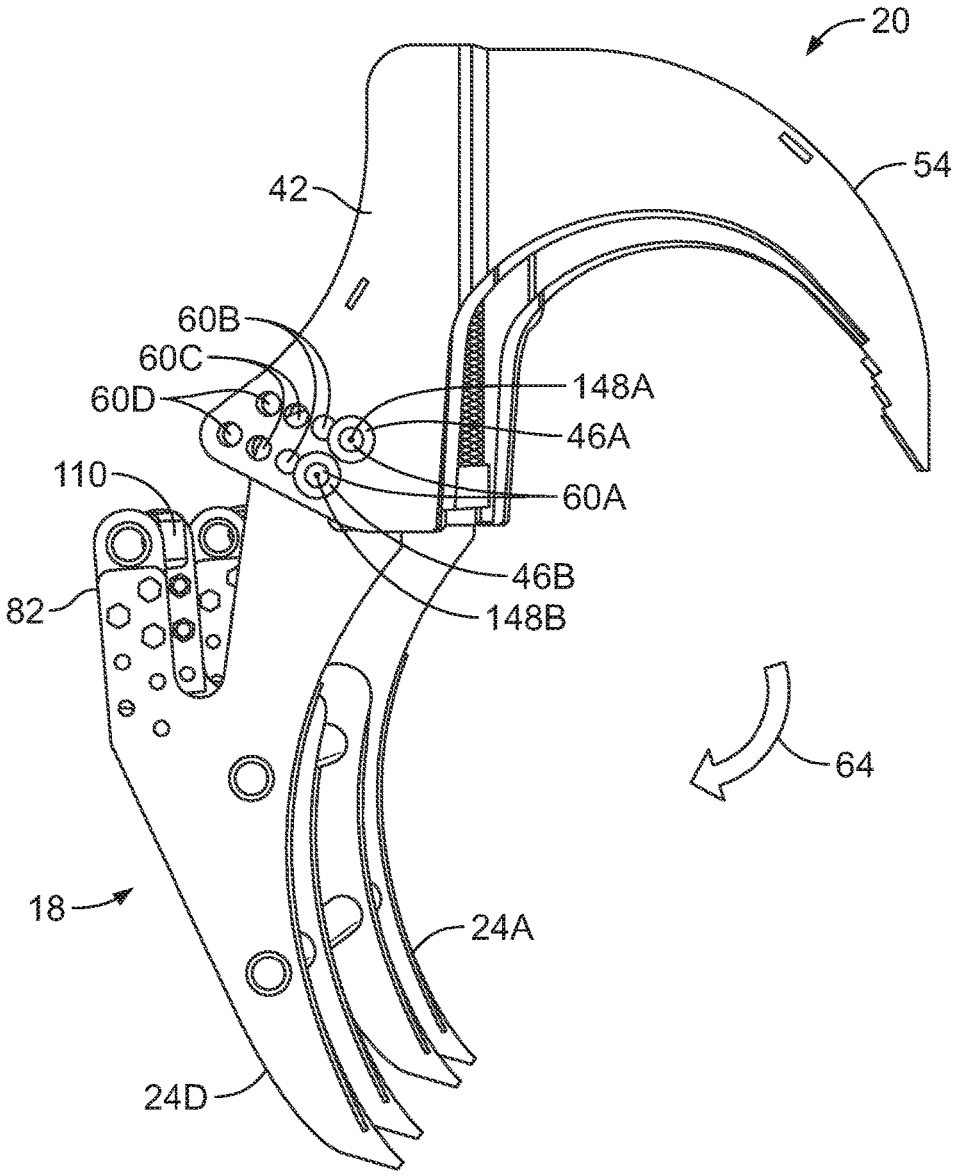
FIG. 10 illustrates a second side view of a lower claw pivotally secured to an upper claw with fasteners removably retained within first coupling openings, according to an embodiment of the present disclosure.

FIG. 10 illustrates a second side view of the lower claw 18 pivotally secured to the upper claw 20 with fasteners 46 removably retained within first coupling openings 60A, or a first pair of coupling openings, according to an embodiment of the present disclosure. For example, FIGS. 6-9 may illustrate a left side of the grappling assembly 10, and FIG. 10 may illustrate a right side of the grappling assembly 10.

Referring to FIGS. 6 and 10, the lower claw 18 is pivotally secured to the upper claw 20. The mating openings 160 of the mounting ends 80 of the lower claw 18 are axially aligned with the first coupling openings 60A of each of the lateral walls 42 of the upper claw 20. Fasteners 46 may be removably retained within the first coupling openings 60A on both the right side and the left side of the grappling assembly 10. In the connected position, the upper claw 20 pivots with respect to the lower claw 18 in the direction of arc 64 about the pivot axes defined by the fasteners 46. The first pivot axis 148A extends substantially horizontally between the fastener 46A disposed at the left side of the grappling assembly 10 (e.g., as shown in FIG. 6) and the fastener 46A disposed at the right side of the grappling assembly 10 (as shown in FIG. 10). Additionally, the first pivot axis 148B extends substantially horizontally between the fastener 46B disposed at the left side of the grappling assembly 10 and the fastener 46B disposed at the right side of the grappling assembly 10. As such, the pivot axis 148B is axially aligned with respect to the pivot axis 148A. The fasteners 46A, 46B extending through the first coupling openings 60A define the first pivot axes 148A, 148B about which the upper claw 20 rotates with respect to the lower claw 18.

Accordingly, adjusting or changing the position of the fasteners 46 to pivotally secure the lower claw 18 to the upper claw 20 changes the position of the pivot axes about which the upper claw 20 pivots with respect to the lower claw 18. Changing the position of the pivot axes may also change how wide the upper claw 20 may be spread apart from the lower claw 18, may also change an amount of grasping force that may be generated by the lower and upper claws 18, 20, or the like, relative to the position of the pivot axes not changing. For example, a distance between the fasteners and the distal tips 30, 56 of the teeth 24, 54 of the lower and upper claws 18, 20 when the fasteners 46 are positioned within the fourth coupling openings 60D is greater than a distance between the fasteners 46 and the distal tips of the teeth when the fasteners 46 are positioned within the first, second, and third coupling openings 60A-C. Accordingly, changing the distance between the pivot axes and the distal tips of the teeth changes a length of the moment arm of the upper claw 20 as the upper claw 20 pivots in the direction of arc 64 with respect to the lower claw 18.

Moreover, it is to be understood that the terms "first" and "second" are merely with respect to the orientations shown in the drawings. The first and second claws may be oriented such that they open in non-vertical orientations, such that the one or more pivot axes may extend in non-horizontal orientations or directions. For example, the first and second claws may be oriented in a perpendicular direction such that the pivot axes extend in a vertical direction and the claws are configured to close about a vertical axis.

Additionally, is it to be understood that the lateral walls 42 of the upper claw 20 may include any number of coupling openings 60, and each coupling opening 60 may have any shape, size, configuration, or the like, with respect to each other coupling opening 60. In one embodiment, the fasteners 46 may be removably retained within a single coupling opening instead of within pairs of coupling openings. Additionally, the mounting ends 80 of the lower claw 18 may include any number of corresponding mating openings 160 that are configured to be aligned with the coupling openings 60 of the upper claw 20 in order to pivotally secure the lower claw 18 to the upper claw 20.

Figure 11:
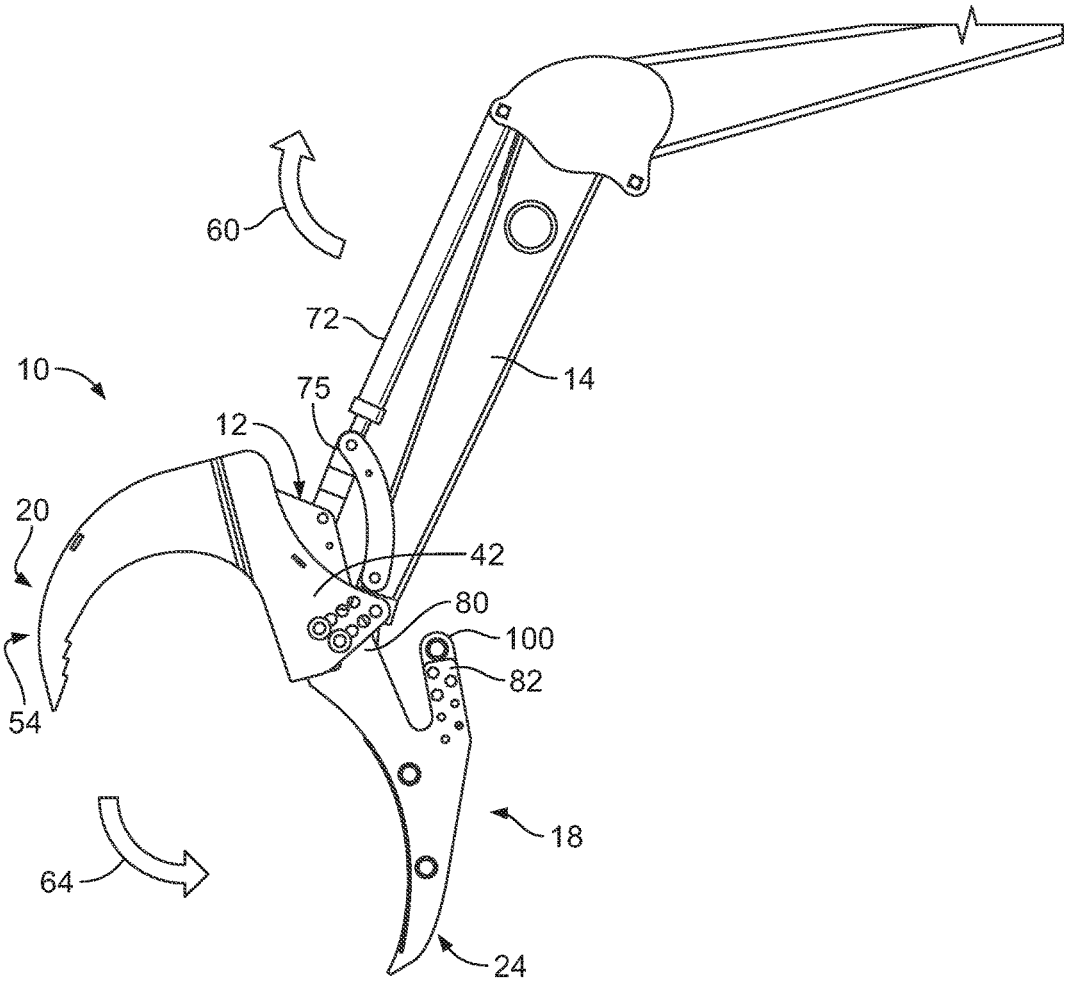
FIG. 11 illustrates a perspective side view of a grappling assembly in a fully-opened position, according to an embodiment of the present disclosure.
Figure 12:
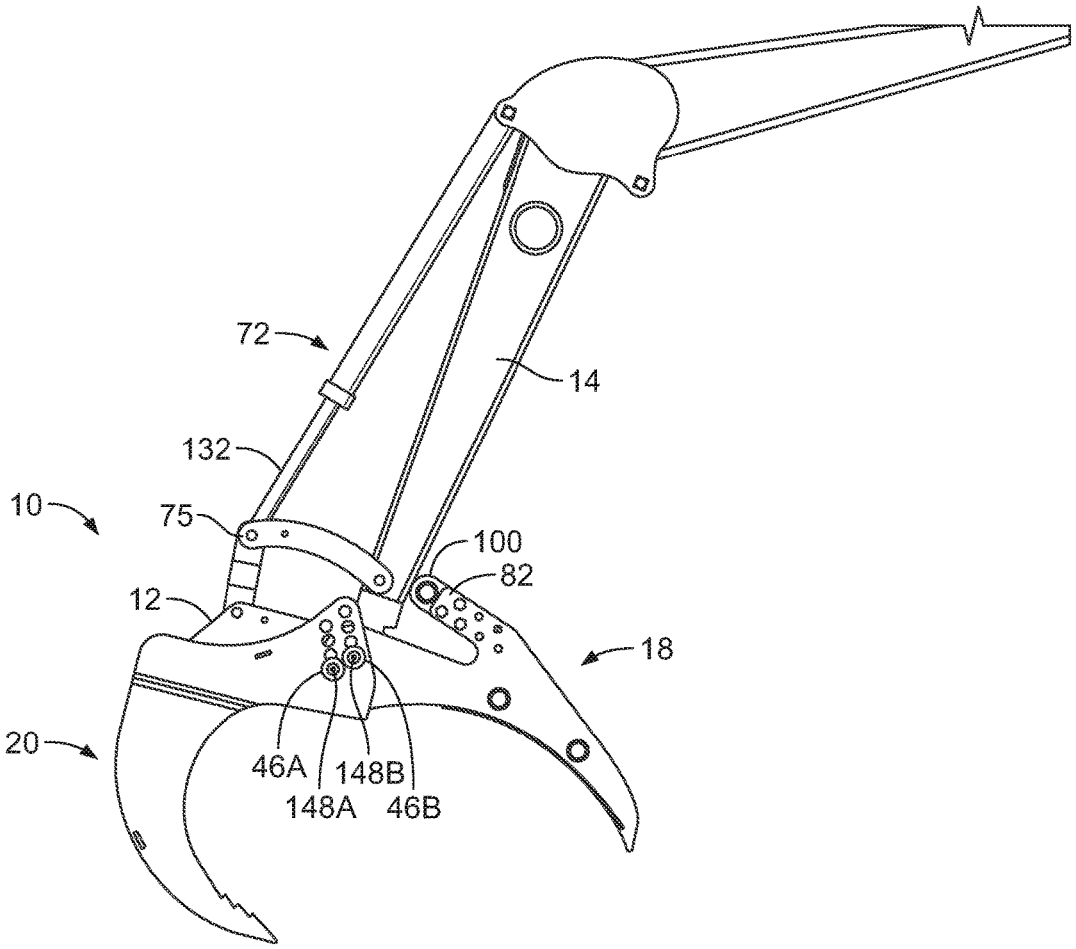
FIG. 12 illustrates a perspective side view of an upper claw and a lower claw rotating about fasteners at first pivot axes, according to an embodiment of the present disclosure.
Figure 13:
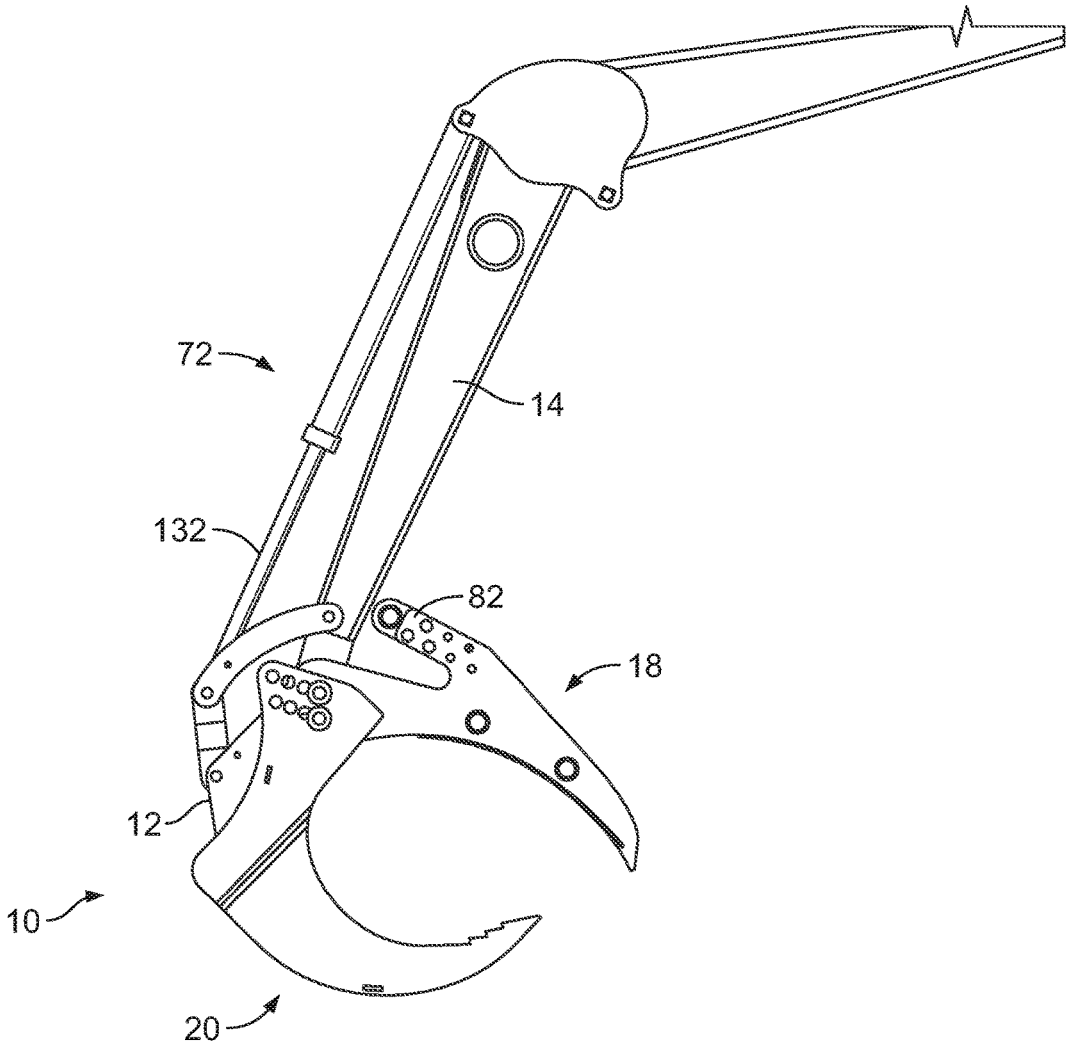
FIG. 13 illustrates a perspective side view of an upper claw and a lower claw rotating about fasteners at first pivot axes, according to an embodiment of the present disclosure.
Figure 14:
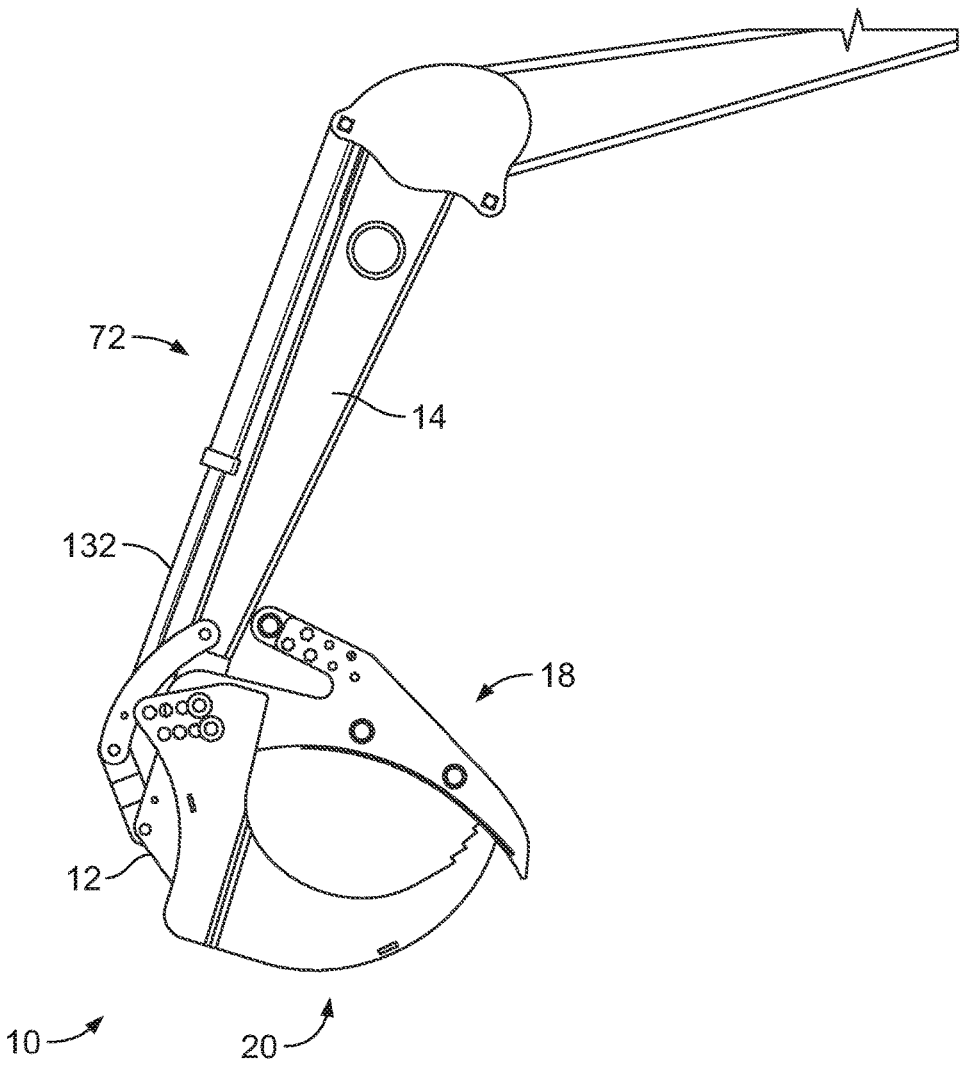
FIG. 14 illustrates a perspective side view of a grappling assembly in a fully-closed position, according to an embodiment of the present disclosure.

FIG. 11 illustrates a perspective side view of a grappling assembly 10 in a fully-opened position, according to an embodiment of the present disclosure. FIGS. 12 and 13 illustrate an upper claw 20 and a lower claw 18 rotating about fasteners at first pivot axes. FIG. 14 illustrates the grappling assembly 10 in a fully-closed position.

Figure 15:
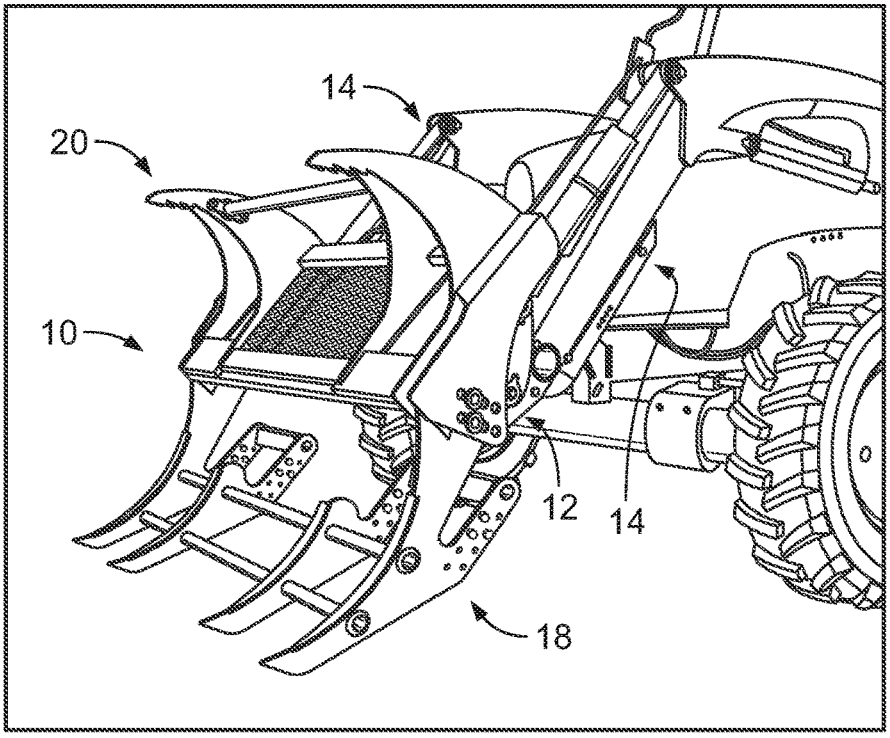
FIG. 15 illustrates a perspective front view of a grappling assembly connected to two moveable arms, according to an embodiment of the present disclosure.
Figure 16:
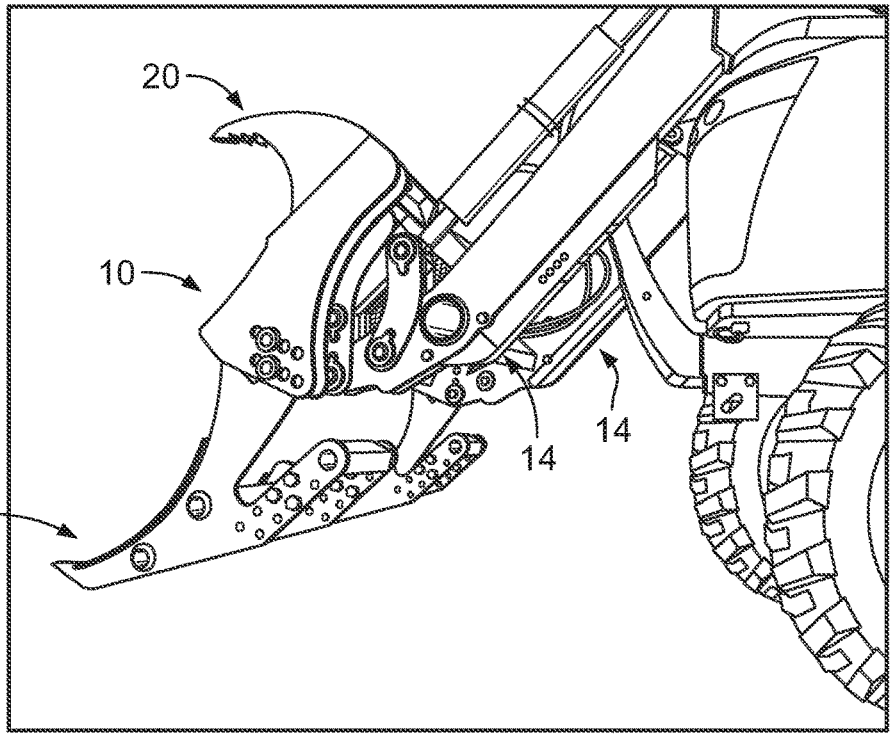
FIG. 16 illustrates a perspective back view of the grappling assembly of FIG. 15, according to an embodiment of the present disclosure.

Referring to FIGS. 11-14, a coupler 12 may be pivotally secured to a distal end of a moveable arm 14. FIGS. 11-14 illustrates a first side view (e.g., a left side view) of the coupler 12 pivotally secured to one moveable arm 14. Additionally, a right side view (not shown) may illustrate a second coupler pivotally secured to a second moveable arm 14 such that the two moveable arms 14 are connected to the grappling assembly 10. For example, FIGS. 15 and 16 illustrate a perspective front view and a perspective back view, respectively, of the grappling assembly 10 connected to the two moveable arms 14, according to an embodiment of the present disclosure. Optionally, more than two or less than two couplers 12 and/or moveable arms 14 may be securely coupled with the grappling assembly 10.

The coupler 12 may include one or more mating surfaces and/or features (not shown) that are configured to mate with and secure the grappling assembly 10 to the coupler 12. In one embodiment, the upper claw 20 may include a reciprocal bracket that may engage with a ramped portion of each coupler and the upper claw 20 may include a lower reciprocal bracket that may engage or mate with a lower protuberance of each coupler. Optionally, each coupler may include a stud at an upper end and a connecting peg or plunger that may be actuated outwardly from a lower end of the coupler. The upper claw 20 may include an opening that may be configured to receive the stud of the coupler and may include a peg-retaining member or reciprocal housing that may be configured to receive the peg or plunger of the coupler in order to securely couple the grappling assembly 10 to the coupler 12. The coupler 12 may be further described in U.S. Pat. No. 7,559,270, entitled "Hydraulic Cylinder System," which is hereby incorporated by reference in its entirety.

It is to be understood that embodiments of the present disclosure may be configured and modified to attach and detach from various types of couplers, other than those shown. For example, the couplers may be sized and shaped differently than shown, and the grappling assembly described in the present disclosure may be sized and shaped to be attached and detached from such a coupler. Optionally, the grappling assembly may be separated into two distinct grappling assemblies such that each grappling assembly is securely connected with each moveable arm. Optionally, the one or more grappling assemblies may be securely coupled with the one or more moveable arms without couplers.

As noted, the grappling assembly 10 may be configured to removable connect to the couplers 12 connected to the moveable arms 14 of the utility component (as shown in FIGS. 15 and 16). The moveable arms 14 may be configured to be rotated up and down in the directions of arc 60. Actuating cylinders 72 may connect to upper portions of the couplers 12 through linkages 75. The actuating cylinders 72 may be hydraulic, pneumatic, and/or spring-operated, and may be configured to extend and retract with respect to the couplers 12. When extension members 132 of the cylinders extend toward the couplers 12, the couplers 12 pivot downwardly in the direction of arc 64. When the extension members 132 of the cylinders 72 retract with respect to the couplers 12, the couplers 12 pivot upwardly in the direction that is opposite that of arc 64.

Additionally, adjusting the position of the pivot axes, and thereby the position of the lower claw 18 with respect to the upper claw 20, allows the lower claw 18 to operate at a position that may be closer to or further away from a pivot point at the end of the moveable arm 14. For example, the lower claw 18 may need to be disposed a distance away from the end of the moveable arm 14. The first and second fasteners 46A, 46B may be disposed within the first coupling openings 60A when using of the grappling assembly 10 in a first operating condition. Alternatively, the lower claw 18 may need to be disposed closer to the end of the moveable arm 14 when using the grappling assembly 10 in a different, second operating condition. For example, the position of the first and second fasteners 46A, 46B may need to be adjusted such that the fasteners 46A, 46B may be removed from the first coupling openings 60A and disposed within the second, third, or fourth coupling openings 60B-D.

As shown in FIG. 11, the grappling assembly 10 is in a fully-opened position. The extension member 132 of the cylinder 72 may be in a fully retracted position in order to fully draw the upper claw 20 open about the first pivot axes (shown in FIG. 6) with respect to the lower claw 18. Referring to FIGS. 12-14, the cylinder extends the extension member 132 in order to pivot the upper claw 20 towards the lower claw 18 about the first pivot axes 148A, 148B defined by the fasteners 46A, 46B removable retained within the first coupler openings 60A. The stop bars 100 (shown in FIGS. 2, 3, and 5) of the lower claw 18 may be wedged against the moveable arm 14, thereby fixing the lower claw 18 in position. For example, as the upper claw 20 rotates towards the lower claw 18, any structure between the upper claw 20 and the lower claw 18 will rotate the lower claw 18 towards the moveable arm 14 with increased rotation of the upper claw 20 into the structure in the direction of arc 64. Optionally the arcuate teeth 24 of the lower claw 18 may be dug into the ground, and the moveable arm 14 moved in order to wedge the lower claw 18 in place. As the upper claw 20 continues to rotate, the upper claw 20 forces the structure into the lower claw 18 until the lower claw 18 wedges against the moveable arm 14, thereby preventing further rotation of the lower claw 18 in the direction of arc 64. The upper claw 20 may continue to be pivoted in the direction of arc 64 about the first pivot axes 148A, 148B until the structure is firmly compressed or otherwise grasped between the upper claw 20 and the lower claw 18, which is wedged against the moveable arm 14.

In one or more embodiments, the position of the lower claw 18 may be adjusted in order for the lower and upper claws 18, 20 to be able to rotate to a fully-opened position and a fully-closed position without the stop bars 100 interfering with features of a variety of moveable arms. For example, the grappling assembly 10 may be first operably coupled with a first moveable arm 14 of a utility equipment and then subsequently be operably coupled with a different, moveable arm of a different piece of utility equipment that has a configuration that is different than the first moveable arm. The position of the lower claw 18 relative to the upper claw 20 may be adjusted such that the stop bars 100 do not interfere with different strands, stops, linkages, or the like, of the different moveable arms of the different utility equipment. Optionally, the position of the lower claw 18 may remain the same, and alternatively the position of the stop bars 100 may be adjusted so that the stop bars 100 do not interfere with different strands, stops, linkages, or the like, of the two different moveable arms of the different utility equipment.

Embodiments of the present disclosure provide a method of pivotally securing an upper claw 20 to a lower claw 18 of a grappling assembly 10. The method includes axially aligning one or more mating openings of the lower claw with one or more coupling openings of the upper claw. Fasteners are removably retained within first coupling openings of the upper claw and within the mating openings of the lower claw. The upper claw 20 and the lower claw 18 are configured to rotate about the fasteners at first pivot axes when the fasteners are retained within the first coupling openings of the upper claw and within the mating openings of the lower claw. The first pivot axes extend through the first coupling openings of the upper claw and the mating openings of the lower claw. The method also includes removably attaching the grappling assembly to a moveable arm of a utility component.

Referring to FIGS. 1-16, embodiments of the present disclosure provide a grappling assembly that includes a lower claw pivotally secured to an upper claw at one or more coupling openings and corresponding mating openings. The different coupling openings changes the pivot axes about which the upper claw rotates with respect to the lower claw, thereby changing a size at which the upper and lower claws may be spread apart when the grappling assembly is in the fully-opened position. Additionally, changing the pivot axes changes an amount of force that the grappling claws can generate. As such, embodiments of the present disclosure provide an adjustable and more efficient grappling assembly in comparison to other known grapplers.

The grappling assembly may be configured to grasp one or more structures through only a single actuating cylinder. For example, only a single actuating cylinder connected to the upper claw may be used to pivot the upper claw towards the lower claw. The lower claw may wedge up against the moveable arm, thereby providing leverage with respect to the closing upper claw. Optionally, two or more actuating cylinders may be connected to a single grappling assembly, or may be connected to two or more separate grappling assemblies.

The various grasping interfaces, shapes, sizes, orientations, connecting interferences, and fasteners shown in the illustrations are merely exemplary. It is to be understood that various configurations of the upper and/or lower claws may be used, that various connecting interferences may be used to pivotally secure the upper claw to the lower claw and/or to connect the grappling assembly to the moveable arm.

The grappling assembly may have one or more stops (which may move or "float" as the grappling assembly moves) that allows the grappling assembly to quickly and easily connect to one or more couplers, for example, without the need for an operator to manipulate the grappling assembly with his/her hands. The stop(s) may be sized and shaped so that it is wide enough to be universally used with various couplers. As such, the stop(s) may be sized and shaped to not interfere with bucket stops that some loaders have welded to loader arm ends, for example. Further, the stop(s) may eliminate the need to connect additional linkage to the grappling assembly that would connect opposed claws.

Certain embodiments of the present disclosure provide grappling assemblies that may be universally used with various other couplers and quick-connecting systems and methods than those shown. While certain examples of couplers and quick connecting systems and methods are shown, it is to be understood that embodiments of the present disclosure may be used with numerous other couplers and systems.

Moreover, embodiments of the present disclosure provide grappling assemblies that may be larger or smaller than shown. The grappling assemblies may be sized and shaped based on the size and stability of the device, vehicle, or the like, to which they are to be attached.

Embodiments of the present disclosure provide grappling assemblies that provide an operator with the benefit of grasping, grabbing, or the like, with claws, as described above, that may be driven by hydraulic power as found on a typical loader, for example. As such, embodiments of the present disclosure may use the existing structure of a loader, for example, instead of requiring additional hydraulics, plumbing, and the like.

Additionally, certain embodiments of the present disclosure provide a system and method for hands-free attachment and detachment of a grappling assembly to a loader, for example. As such, an operator is not required to handle and manipulate the grappling assembly in order to secure it to a loader, for example. Accordingly, the operator is spared the labor and mess that would otherwise arise when hooking up separate hydraulics and the like to the grappling assembly and/or the loader, for example.

As noted above, while various embodiments describe an upper claw operatively connected to an actuating cylinder, such as through a coupler, while the lower claw is not connected to an actuating cylinder, it is to be understood that such a configuration may be reversed. For example, a lower claw may be operatively connected to an actuating cylinder extending below a moveable arm, while the upper claw may not be connected to an actuating cylinder.

As noted above, the upper claw may pivotally connect to the lower claw at one or more pivot axes. The pivot axes may be completely aligned with a pivot axis on a coupler or a distal end of a moveable arm. Optionally, the pivot axes may be aligned in an offset manner with respect to the pivot axis of the coupler or the distal end of the moveable arm. For example, the pair of pivot axes of the grappling assembly may be offset between 1-15 degrees with respect to the pivot axis of the coupler or the moveable arm. Optionally, the offset angle may exceed 15 degrees. Also, for example, the pivot axes of the grappling assembly may be offset from the pivot axis of the coupler within a radius, such as a 10" radius. Alternatively, the radius may be greater or less than 10". In this manner, the pivot axes of the grappling assembly may be substantially axially aligned within a pivot radius of an arm pivot axis of a moveable arm, for example. The claws may be connected within a radius area of the pivot point of the loader arm end, for example.

Additionally, embodiments of the present disclosure provide grappling assemblies that include a stop, such as a stop bar, that is configured to be wedged into a portion of the moveable arm to provide a leverage point. The stop, which may swing forward when force is not applied to the lower claw, for example, provides a resistive leverage point, thereby allowing the upper claw to pinch or otherwise close with respect to the lower claw.

Unlike known grapplers, embodiments of the present disclosure do not require a complicated or elaborate linkage between the moveable arm and the grappling assembly. Certain embodiments of the present disclosure do not require additional bushings, sleeves, and/or pins to connect to couplers or distal ends of moveable arms. Further, embodiments of the present disclosure provide grappling assemblies that may be operated through the use of a single actuating cylinder operatively connected to only one of two pivotal grasping claws.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A grappling assembly configured to connect to a moveable arm of a utility component, wherein the grappling assembly comprises:

a first claw including first grasping surfaces, a first pair of first and second coupling openings, and a second pair of third and fourth coupling openings;

a second claw including second grasping surfaces, one or more first mating openings, and one or more second mating openings; and a first fastener and a second fastener configured to pivotally secure the first claw to the second claw, wherein the first fastener and the second fastener are configured to be removably retained within the first pair of coupling openings and the second pair of the coupling openings of the first claw and within the one or more first mating openings and the one or more second mating openings of the second claw, wherein the first claw and the second claw are configured to rotate about the first fastener at a first pivot axis when the first fastener is retained within the first coupling opening of the first claw and within the one or more first mating openings of the second claw, and rotate about the second fastener at a second pivot axis that differs from the first pivot axis when the second fastener is retained within the second coupling opening of the first claw and within the one or more first mating openings of the second claw, and wherein the first claw and the second claw are configured to rotate about the first fastener at a third pivot axis that differs from the first and second pivot axes when the first fastener is retained within the third coupling opening of the first claw and within the one or more second mating openings of the second claw, and rotate about the second fastener at a fourth pivot axis that differs from the first, second, and third pivot axes when the second fastener is retained within the fourth coupling opening of the first claw and within the one or more second mating openings of the second claw.

2. The grappling assembly of claim 1, wherein the grappling assembly is configured to connect to the moveable arm through a coupler.

3. The grappling assembly of claim 1, wherein the second claw includes one or more stop bars, wherein the stop bars are configured to prevent rotation of the second claw in a direction towards the moveable arm.

4. The grappling assembly of claim 1, wherein the first claw includes a main housing, wherein the first grasping surfaces are configured to extend a distance away from the main housing.

5. The grappling assembly of claim 4, wherein the first claw includes lateral walls that extend a distance away from the main housing, wherein the first second, third, and fourth coupling openings of the first claw extend through at least one of the lateral walls.

6. The grappling assembly of claim 4, wherein the first claw includes a screen that extends at least partially along a surface of the main housing between the first grasping surfaces.

7. The grappling assembly of claim 1, wherein the first claw includes grasping teeth and one or more connecting rods operably coupled with the grasping teeth.

8. The grappling assembly of claim 1, wherein the second claw includes arcuate teeth and one or more connecting rods operably coupled with the arcuate teeth, wherein at least one of the arcuate teeth includes a mounting end, wherein the mating openings of the second claw extend through the mounting end of the at least one of the arcuate teeth.

9. The grappling assembly of claim 1, wherein the grappling assembly is devoid of any additional linkages between the first claw and the second claw.

10. The grappling assembly of claim 1, wherein each first grasping surface of the first claw includes a grip, wherein the grips maintain a position of a structure between the first grasping surfaces of the first claw and the second grasping surfaces of the second claw.

11. The grappling assembly of claim 1, wherein the first claw further includes a third pair of fifth and sixth coupling openings, and a fourth pair of seventh and eighth coupling openings, and wherein the second claw further includes one or more third mating openings, and one or more fourth mating openings.

12. A grappling assembly configured to connect to a moveable arm of a utility component, wherein the grappling assembly comprises:

an upper claw including one or more lower grasping surfaces, a first pair of first and second coupling openings, and a second pair of third and fourth coupling openings;

a lower claw including one or more upper grasping surfaces, one or more first mating openings, and one or more second mating openings; and a first fastener and a second fastener configured to pivotally secure the upper claw to the lower claw, wherein the first fastener and the second fastener are configured to be removably retained within the first pair of coupling openings and the second pair of the coupling openings of the upper claw and within the one or more first mating openings and the one or more second mating openings of the lower claw, wherein the upper claw and the lower claw are configured to rotate about the first fastener at a first pivot axis when the first fastener is retained within the first coupling opening of the upper claw and within the one or more first mating openings of the lower claw, and rotate about the second fastener at a second pivot axis that differs from the first pivot axis when the second fastener is retained within the second coupling opening of the upper claw and within the one or more first mating openings of the lower claw, wherein the first claw and the second claw are configured to rotate about the first fastener at a third pivot axis that differs from the first and second pivot axes when the first fastener is retained within the third coupling opening of the upper claw and within the one or more second mating openings of the lower claw, and rotate about the second fastener at a fourth pivot axis that differs from the first, second, and third pivot axes when the second fastener is retained within the fourth coupling opening of the upper claw and within the one or more second mating openings of the lower claw, and wherein the lower claw includes one or more stop bars, wherein the stop bars are configured to prevent rotation of the lower claw in a direction towards the moveable arm.

13. The grappling assembly of claim 12, wherein the upper claw further includes a third pair of fifth and sixth coupling openings, and a fourth pair of seventh and eighth coupling openings, and wherein the lower claw further includes one or more third mating openings, and one or more fourth mating openings.

14. The grappling assembly of claim 12, wherein the grappling assembly is configured to connect to the moveable arm through a coupler.

15. The grappling assembly of claim 12, wherein the upper claw includes a main housing, wherein the first grasping surfaces are configured to extend a distance away from the main housing.

16. The grappling assembly of claim 15, wherein the upper claw includes lateral walls that extend a distance away from the main housing, wherein the first second, third, and fourth coupling openings of the upper claw extend through at least one of the lateral walls.

17. The grappling assembly of claim 15, wherein the upper claw includes a screen that extends at least partially along a surface of the main housing between the first grasping surfaces.

18. The grappling assembly of claim 12, wherein the upper claw includes grasping teeth and one or more connecting rods operably coupled with the grasping teeth.

19. The grappling assembly of claim 12, wherein the lower claw includes arcuate teeth and one or more connecting rods operably coupled with the arcuate teeth, wherein at least one of the arcuate teeth includes a mounting end, wherein the mating openings of the second claw extend through the mounting end of the at least one of the arcuate teeth.

20. A system comprising:

a moveable arm of a utility vehicle; and a grappling assembly configured to be removably secured to the moveable arm, wherein the grappling assembly includes:

an upper claw including one or more lower grasping surfaces, a first pair of first and second coupling openings, and a second pair of third and fourth coupling openings;

a lower claw including one or more upper grasping surfaces, one or more first mating openings, and one or more second mating openings;

a first fastener and a second fastener configured to pivotally secure the upper claw to the lower claw, wherein the first fastener and the second fastener are configured to be removably retained within the first pair of coupling openings and the second pair of the coupling openings of the upper claw and within the one or more first mating openings and the one or more second mating openings of the lower claw, wherein the upper claw and the lower claw are configured to rotate about the first fastener at a first pivot axis when the first fastener is retained within the first coupling opening of the upper claw and within the one or more first mating openings of the lower claw, and rotate about the second fastener at a second pivot axis that differs from the first pivot axis when the second fastener is retained within the second coupling opening of the upper claw and within the one or more first mating openings of the lower claw, wherein the first claw and the second claw are configured to rotate about the first fastener at a third pivot axis that differs from the first and second pivot axes when the first fastener is retained within the third coupling opening of the upper claw and within the one or more second mating openings of the lower claw, and rotate about the second fastener at a fourth pivot axis that differs from the first, second, and third pivot axes when the second fastener is retained within the fourth coupling opening of the upper claw and within the one or more second mating openings of the lower claw, wherein the lower claw includes one or more stop bars, wherein the stop bars are configured to prevent rotation of the lower claw in a direction towards the moveable arm, wherein the upper claw includes a main housing, wherein the first grasping surfaces are configured to extend a distance away from the main housing, the upper claw includes lateral walls that extend a distance away from the main housing, wherein the first, second, third, and fourth coupling openings of the first claw extend through each of the lateral walls, wherein the upper claw includes grasping teeth and one or more first connecting rods operably coupled with the grasping teeth, and wherein the lower claw includes arcuate teeth and one or more second connecting rods operably coupled with the arcuate teeth, wherein at least one of the arcuate teeth includes a mounting end, wherein the mating openings of the second claw extend through the mounting end of the at least one of the arcuate teeth.

* * * * *